US009786996B2

(12) United States Patent
Fasenfest et al.

(10) Patent No.: US 9,786,996 B2
(45) Date of Patent: Oct. 10, 2017

(54) MICROSTRIP PATCH ANTENNA ARRAY

(71) Applicant: Tyco Electronics Corporation, Berwyn, PA (US)

(72) Inventors: Kathleen Fasenfest, Union City, CA (US); Paul Craig Tally, Menlo Park, CA (US); Thomas Dean Ratzlaff, Menlo Park, CA (US)

(73) Assignee: TE CONNECTIVITY CORPORATION, Berywyn, PA (US)

( * ) Notice: Subject to any disclaimer, the term of this patent is extended or adjusted under 35 U.S.C. 154(b) by 547 days.

(21) Appl. No.: 14/257,693

(22) Filed: Apr. 21, 2014

(65) Prior Publication Data

US 2016/0218439 A1 Jul. 28, 2016

(51) Int. Cl.

| | |
|---|---|
| ***H01Q 1/38*** | (2006.01) |
| ***H01Q 21/06*** | (2006.01) |
| ***H01Q 1/12*** | (2006.01) |
| ***H01Q 21/08*** | (2006.01) |
| ***H01Q 9/04*** | (2006.01) |
| *H01Q 1/24* | (2006.01) |

(52) U.S. Cl.

CPC ..... *H01Q 21/065* (2013.01); *H01Q 1/1207* (2013.01); *H01Q 9/045* (2013.01); *H01Q 9/0407* (2013.01); *H01Q 21/08* (2013.01); *H01Q 1/246* (2013.01)

(58) Field of Classification Search

CPC .... H01Q 21/065; H01Q 9/0407; H01Q 9/045; H01Q 21/08

USPC ..... 343/700 MS, 853

See application file for complete search history.

(56) References Cited

U.S. PATENT DOCUMENTS

| | | | | |
|---|---|---|---|---|
| 2003/0067410 | A1* | 4/2003 | Puzella | H01Q 9/0407 343/700 MS |
| 2010/0053025 | A1* | 3/2010 | Van Der Poel | H01Q 1/523 343/893 |
| 2010/0053026 | A1* | 3/2010 | Van Der Poel | H01Q 1/523 343/908 |

FOREIGN PATENT DOCUMENTS

| | | |
|---|---|---|
| EP | 2159876 A1 | 3/2010 |
| WO | WO-03/030301 A1 | 4/2003 |

OTHER PUBLICATIONS

International Search Report for International Application No. PCT/US2015/026609, Jul. 21, 2015.

* cited by examiner

*Primary Examiner* — Dieu H Duong

(57) ABSTRACT

A patch antenna array includes a plurality of patch antenna elements spaced apart from each other and arranged as an array. Each patch antenna element has a substrate, a radiating patch associated with the substrate and a ground plane associated with the substrate. The patch antenna elements are discrete and separate from each other. At least one element frame holds the discrete antenna elements in the array. Each element frame captures and positions at least two patch antenna elements relative to each other.

17 Claims, 2 Drawing Sheets

MICROSTRIP PATCH ANTENNA ARRAY

BACKGROUND OF THE INVENTION

The subject matter disclosed herein relates generally to microstrip patch antenna arrays.

Microstrip patch antennas are commonly used with electronic receivers for communication systems, such as global navigation satellite systems (GNSSs). A microstrip patch antenna is a type of antenna that typically includes a flat sheet, or patch, of metal that is mounted over a ground plane. Known patch antennas are not without disadvantages. For example, patch antennas arranged in arrays are typically printed on a single substrate. This approach causes the microstrip patch antennas to produce surface waves in the substrate, reducing the radiated power and degrading the radiation pattern performance of the array. Some known patch antenna arrays overcome surface wave excitation problems by providing arrays of individual microstrip patch antennas, each with a separate substrate. These individual microstrip patch antennas can be secured to a surface using adhesive; however, such arrays are not suitable for all applications. For example, the adhesive may fail in applications subject to extreme environmental conditions, such as temperature variations, as well as vibration. Applications such as aeronautical, marine and vehicle implementations may subject the arrays to environmental conditions that are not suitable for mechanical retention using adhesives.

BRIEF DESCRIPTION OF THE INVENTION

In one embodiment, a patch antenna array is provided including a plurality of patch antenna elements spaced apart from each other and arranged as an array. Each patch antenna element has a substrate, a radiating patch associated with the substrate and a ground plane associated with the substrate. The patch antenna elements are discrete and separate from each other. At least one element frame holds the discrete antenna elements in the array. Each element frame captures and positions at least two patch antenna elements relative to each other.

Optionally, the element frame may be positioned between corresponding patch antenna elements. The substrates, the radiating patches, and the ground planes of the patch antenna elements may be separated from one another with the element frame positioned therebetween.

Optionally, each patch antenna element may have a top, a bottom and sides extending between the top and the bottom. The patch antenna elements may be arranged in the array such that the sides of adjacent patch antenna elements face one another and are separated by gaps. The element frame may be positioned in the corresponding gap and may engage the corresponding patch antenna elements to capture the patch antenna elements. The element frame may engage at least two sides of corresponding patch antenna elements.

Optionally, the element frame may be a lattice frame having longitudinal strips and lateral strips with windows through the lattice frame. The windows may receive corresponding patch antenna elements. The longitudinal strips and lateral strips may engage the corresponding patch antenna elements to capture the patch antenna elements.

Optionally, the at least one element frame may include a plurality of discrete element frames. The element frames may be positioned between different patch antenna elements. The element frames may be positioned to capture four corners of four different patch antenna elements.

Optionally, the substrate may have a thickness between a top and a bottom. The substrate may have a non-constant cross-section along the thickness. The patch antenna element may have a ledge along the bottom. The element frame may engage the ledge to capture the patch antenna element. The element frame may include a rail and a cap extending from the rail. The rail may be positioned between ledges of adjacent patch antenna elements. The cap may extend over the ledges of the corresponding patch antenna elements to capture the patch antenna elements.

In another embodiment, a patch antenna array is provided that includes a plurality of patch antenna elements spaced apart from each other and arranged as an array. Each patch antenna element may have a substrate, a radiating patch associated with the substrate and a ground plane associated with the substrate. The substrate has a base defining a ledge, wherein the plurality of patch antenna elements are discrete and separate from each other with the ledges generally coplanar and spaced apart from each other with gaps defined between adjacent ledges. At least one element frame is received in at least one of the gaps. The at least one element frame captures the ledges of at least two patch antenna elements and holds the positions of the discrete antenna elements in the array relative to each other.

In a further embodiment, an antenna system is provided having feed networks configured to be operatively connected to at least one of a receiver, a transmitter or a transceiver. A patch antenna array is mounted to a mounting surface of a support substrate. The patch antenna array includes a plurality of patch antenna elements spaced apart from each other and arranged as an array. Each patch antenna element has a substrate, a radiating patch associated with the substrate and a ground plane associated with the substrate. Each radiating patch is operatively connected to a corresponding feed network for at least one of receiving radio frequency (RF) waves from the feed network or delivering RF waves to the feed network. The patch antenna elements are discrete and separate from each other. At least one element frame holds the discrete antenna elements in the array. Each element frame captures and positions at least two patch antenna elements relative to each other.

DETAILED DESCRIPTION OF THE INVENTION

Figure 1:
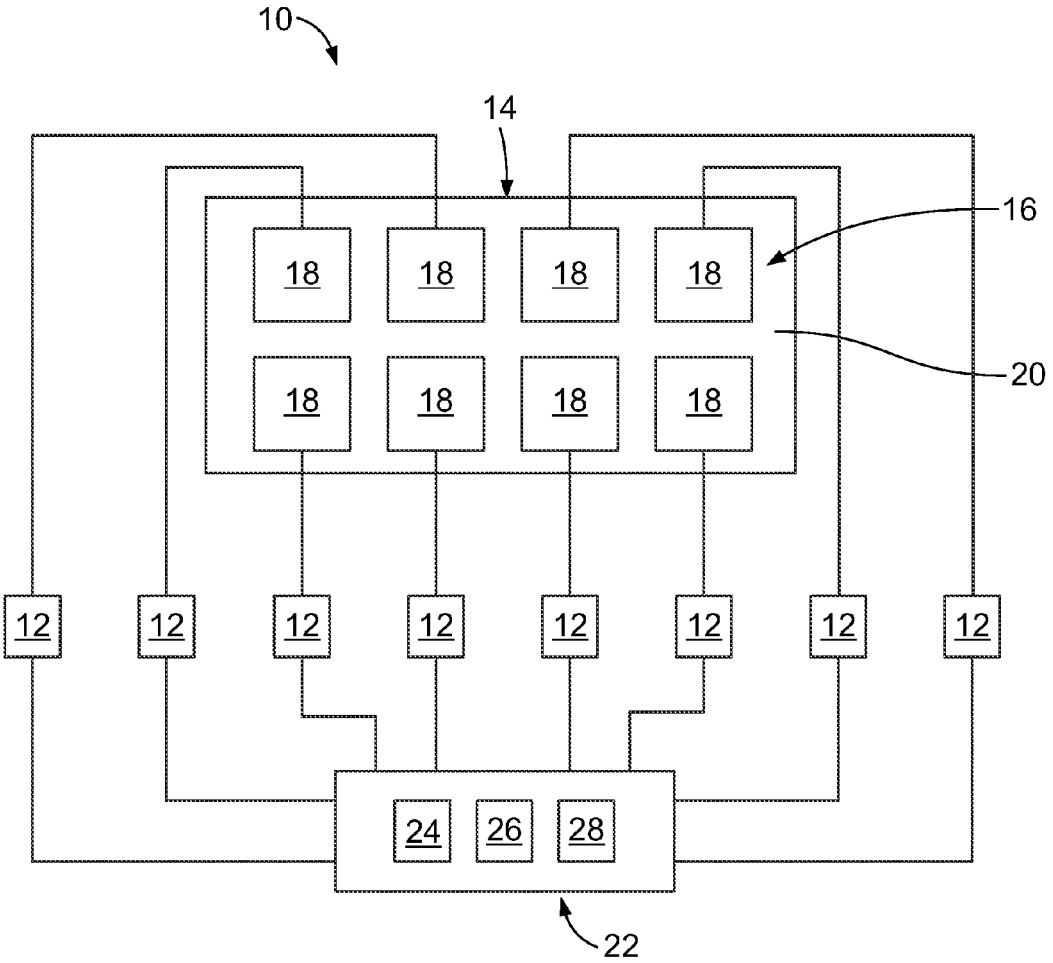
FIG. 1 is a schematic diagram of an exemplary embodiment of an antenna system showing a patch antenna array formed in accordance with an exemplary embodiment.

FIG. 1 is a schematic diagram of an exemplary embodiment of an antenna system 10. The antenna system 10 includes a plurality of feed networks 12 and an antenna assembly 14. The antenna assembly 14 includes a patch antenna array 16 of patch antenna elements 18, such as microstrip patch antenna elements 18. The patch antenna array 16 may include any number of patch antenna elements 18, the antenna assembly 14 may include any number of the patch antenna arrays 16, and the antenna assembly 14 may include any number of patch antenna elements 18 overall. The patch antenna elements 18 may be arranged within the patch antenna array 16 in any pattern, including in the grid pattern shown in FIG. 1 of multiple columns and multiple rows of patch antenna elements 18.

In an exemplary embodiment, the patch antenna elements 18 are discrete and separate components that are arranged together to form the patch antenna array 16. The antenna assembly 14 includes one or more element frames 20 that are used to hold the discrete patch antenna elements 18 in the array. The element frame(s) 20 capture, position and orient the patch antenna elements 18 relative to each other. The element frame(s) 20 mechanically fix the patch antenna elements 18 relative to each other, and may be used to mount the patch antenna elements 18 to a mounting surface of a support substrate, a heat sink, a chassis, and the like.

The antenna system 10 may function as a transmitting antenna system that transmits RF waves into the environment (e.g., the atmosphere) of the antenna system 10, as a receiving antenna system that receives RF waves from the environment of the antenna system 10, or as a combination of a transmitting and a receiving antenna system 10. Each patch antenna element 18 is operatively connected to a corresponding feed network 12 for receiving RF waves from the corresponding feed network 12 and/or for delivering RF waves to the corresponding feed network 12. As shown in FIG. 1, each feed network 12 is operatively connected to one or more processing systems 22, which may or may not be considered a component of the antenna system 10. The operative connection of the feed networks 12 between the processing system 22 and the patch antenna elements 18 enables the feed networks 12 to feed RF energy between the patch antenna elements 18 and the processing system 22. Each feed network 12 may include one or more components (not shown) for converting RF waves received by the patch antenna elements 18 into RF electrical signals for delivery to the processing system 22, and/or vice versa. Optionally, another electrical circuit (not shown) is operatively connected between the feed networks 12 and the processing system 22 for combining the RF electrical signals that correspond to a plurality of patch antenna element 18 and feed network 12 pairs.

The processing system 22 may include one or more transmitters 24, one or more receivers 26, and/or one or more transceivers 28. The inclusion of any transmitters 24, any receivers 26, and any transceivers 28 may depend on whether the antenna system 10 functions as a transmitting antenna system, as a receiving antenna system, or as a combination of a transmitting and a receiving antenna system. The processing system 22 may include any number of the transmitters 24, any number of the receivers 26, and any number of the transceivers 28, the number of each of which may or may not correspond to the number of patch antenna elements 18. The processing system 22 may include other components in addition to the transmitters 24, receivers 26, and transceivers 28.

Each patch antenna element 18 may function as a receiving antenna, a transmitting antenna, or as both a receiving and a transmitting antenna. In other words, each of the patch antenna elements 18 may transmit RF waves into the environment, may receive RF waves from the environment, or may both transmit RF waves and receive RF waves. In some embodiments, all of the patch antenna elements 18 are receiving antennas that do not transmit RF waves. In other embodiments, all of the patch antenna elements 18 are transmitting antennas that do not receive RF waves from the environment, or all of the patch antenna elements 18 are transceiving antennas that both transmit RF waves and receive RF waves. In still other embodiments, the antenna assembly 14 includes a combination of one or more receiving patch antenna elements 18 that do not transmit RF waves, one or more transmitting patch antenna elements 18 that do not receive RF waves, and/or one or more transceiving patch antenna elements 18 that both transmit and receive RF waves.

The antenna system 10 may be any type of antenna system having any application, such as, but not limited to, a controlled reception pattern antenna (CRPA), a global positioning system (GPS) antenna, a global navigation satellite system (GNSS) antenna, an electronically steerable array (ESA), and/or the like. The antenna system 10 may be used as part of signals intelligence (SIGINT) electronically steerable arrays (ESAs), as anti jam (AJ) navigation antenna arrays, or in other applications. The antenna system 10 may be used as part of aeronautical vehicles, such as unmanned aerial vehicles (UAVs); however the antenna system is not intended to be limited to such applications.

Figure 2:
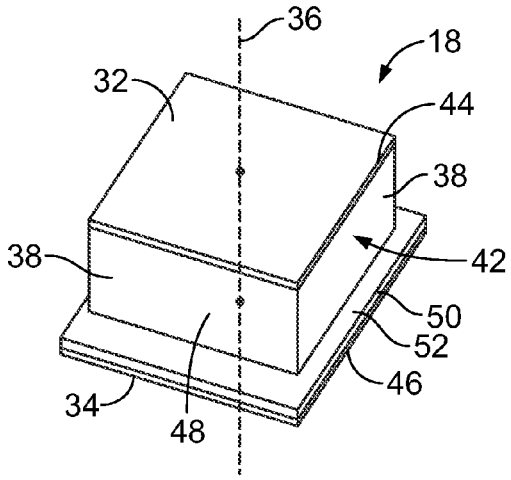
FIG. 2 is a perspective view of an exemplary embodiment a patch antenna element of the patch antenna array.

FIG. 2 is a perspective view of an exemplary embodiment of one of the patch antenna elements 18. The patch antenna element 18 extends between a top 32 and a bottom 34 along a central axis 36. The patch antenna element 18 has sides 38 extending between the top 32 and the bottom 34. In an exemplary embodiment, the patch antenna element 18 include four sides 38 having a generally square or rectangular cross-section leading to a generally box-shaped structure; however the patch antenna element 18 may have other shapes in alternative embodiments, such as a circle, oval, closed curves, triangular, trapezoidal, shapes having more than four sides, and/or the like. The patch antenna element 18 has a thickness measured along the central axis 36.

The patch antenna element 18 includes a dielectric substrate 42, a radiating patch 44 positioned on the substrate 42, and a ground plane 46 associated with the patch antenna element 18. The ground plane 46 may be part of the substrate 42. For example, the ground plane 46 may be a metallized layer or surface on the bottom side of the substrate 42. Alternatively, a separate ground plane or metal surface behind the patch antenna element 18 or the patch antenna array 16 may serve as the ground plane 46. In an exemplary embodiment, the radiating patch 44 is positioned at or near the top 32 and the ground plane 46 is positioned at or near the bottom 34. The patch antenna element 18 may be a layered structure, such as a printed circuit structure. A feed probe (not shown), electrically connected to the feed network 12 (shown in FIG. 1), may be electrically connected to the radiating patch 44 for exciting (i.e., energizing) the radiating patch 44. When excited by the feed probe, the patch antenna element 18 is resonant and thereby transmits and/or receives RF waves.

The substrate 42 of the patch antenna element 18 has a dielectric body 48 that includes a base 50 at the bottom 34. The base 50 is larger than other portion of the body 48, forming a ledge 52 along the perimeter of the body 48. Optionally, the ledge 52 may extend along the entire perimeter of the body 48. Alternatively, the ledge 52 may be discontinuous and have breaks or spaces between various base portions. The ledge 52 may be provided on less than all of the sides 38. Because the base 50 extends outward, the substrate 42 has a non-constant cross-section along the thickness of the substrate 42. The base 50 defines a structure that allows the element frame 20 (shown in FIG. 1) to mechanically hold the patch antenna element 18. For example, the element frame 20 engages the ledge 52 and captures the base 50 to hold the patch antenna element 18.

The substrate body 48 is manufactured from a dielectric material and has a dielectric constant that is greater than the dielectric constant of air. Examples of suitable materials for the substrate body 48 include, but are not limited to, ceramic, rubber, fluoropolymer, composite material, fiberglass, plastic, and/or the like. The body 48 of the substrate 42 is a solid body. By a "solid body", it is meant that the material of at least a majority of the substrate body 48 is in the solid phase. The solid body 48 of the substrate 42 can be distinguished from a non-solid body wherein a majority of the material of the body is in gaseous and/or liquid phase. As used herein, a "solid body" may include one or more portions having material that is in the gaseous phase (e.g., air and/or the like) and/or may include one or more portions having material that is in the liquid phase (e.g., water and/or the like), for example contained within one or more internal pockets (not shown) of the solid body. In the exemplary embodiment of the substrate 42, the material of an approximate entirety of the material substrate body 48 is in the solid phase. But, as should be appreciated from above, the body 48 of the substrate 42 may alternatively include one or more pockets of a gaseous and/or a liquid material and still be considered a "solid body".

The radiating patch 44 is electrically conductive and may be fabricated from any electrically conductive material, such as, but not limited to, copper, gold, silver, aluminum, tin, and/or the like. The pattern and the thickness of the radiating patch 44 may each have any suitable value that enables the patch antenna element 18 to function to transmit and/or receive RF waves as described and/or illustrated herein.

The ground plane 46 may be fabricated from any electrically conductive material, such as, but not limited to, copper, gold, silver, aluminum, tin, and/or the like. In the exemplary embodiment of the patch antenna element 18, the ground plane 46 is larger than the radiating patch 44. The ground plane 46 may have any size and thickness that enables the patch antenna element 18 to function to transmit and/or receive RF waves as described and/or illustrated herein, whether or not the ground plane 46 is common to more than one patch antenna element 18 of the antenna assembly 14 (FIG. 1).

The feed probes may be electromagnetically coupled to the radiating patch 44 for generating a circularly polarized radiation pattern, which causes the patch antenna element 18 to radiate circularly polarized electromagnetic waves. In addition to perfectly circular radiation patterns and electromagnetic waves, a "circularly polarized radiation pattern" and "circularly polarized electromagnetic waves", as used herein, each also include radiation patterns and electromagnetic waves, respectively, which do not have perfectly circular shapes, such as, but not limited to, elliptical shapes and/or the like. Moreover, the term "electromagnetically coupled" is intended to indicate that the feed probes do not physically contact the radiating patch 44. In an exemplary embodiment, the patch antenna element 18 may include multiple feed probes in spaced apart relationship from each other. The excitation phase and the angular orientation of each of the feed probes are selected to generate a circularly polarized radiation pattern. The feed probes may feed the radiating patch 44 at different locations at approximately equal power amplitude, with each location being progressively delayed in phase (e.g., by approximately 90°). The feed network 12 (FIG. 1) may include one or more various components (not shown) for controlling the phase of each of the feed probes, such as, but not limited to, baluns, hybrid couplers, delay lines, and/or the like. The spacing along the substrate body 48 and the phase delay between the locations of adjacent feed probes may be selected to configure the patch antenna element 18 to operate at one or more predetermined modes.

In operation, the patch antenna element 18 transmits RF waves into the environment and/or receives RF waves from the environment. Specifically, the patch antenna element 18 resembles a dielectric loaded cavity. The electric and magnetic fields within the patch antenna element 18 can be found by treating the patch antenna element 18 as a cavity resonator. The feed probes may be configured to efficiently excite the desired cavity mode while suppressing undesirable cavity modes. The desired cavity mode of the patch antenna element 18 is well excited when the feed probes are relatively well coupled to the patch antenna element 18 at the maxima of the desired mode's field distribution within the cavity. The feed probes may provide a relatively efficient impedance match between the patch antenna element 18 and the processing system 22 (FIG. 1). In addition, the feed probes may be configured such that the input reactance of the feed probes is minimized.

The patch antenna element 18 may operate at any frequencies. By "operate", it is meant that the patch antenna element 18 is capable of transmitting and/or receiving RF waves at the particular frequencies. Examples of the operating frequencies of the patch antenna element 18 include, but are not limited to, frequencies above approximately 0.50 GHz, frequencies above approximately 1.00 GHz, frequencies below approximately 3.00 GHz, frequencies below approximately 3.00 GHz, frequencies between approximately 1.00 GHz and 3.00 GHz, and/or the like. The patch antenna element 18 may operate over a frequency band having any bandwidth. Examples of the bandwidth of the operational frequency band of the patch antenna element 18 include, but are not limited to, approximately 100 MHz, approximately 300 MHz, approximately 500 MHz, approximately 600 MHz, and/or the like.

Various parameters of the patch antenna element 18 may be selected to provide the patch antenna element 18 with predetermined operating frequencies and/or with a predetermined bandwidth. For example, the shape of the radiating patch 44, the size and shape of the substrate body 48, the thickness of the substrate body 48, and/or the dielectric constant of the substrate body 48 may be selected to provide the patch antenna element 18 with predetermined operating frequencies and/or with a predetermined bandwidth, for example to provide the increased bandwidth and/or reduced size relative to at least some known patch antennas.

Figure 3:
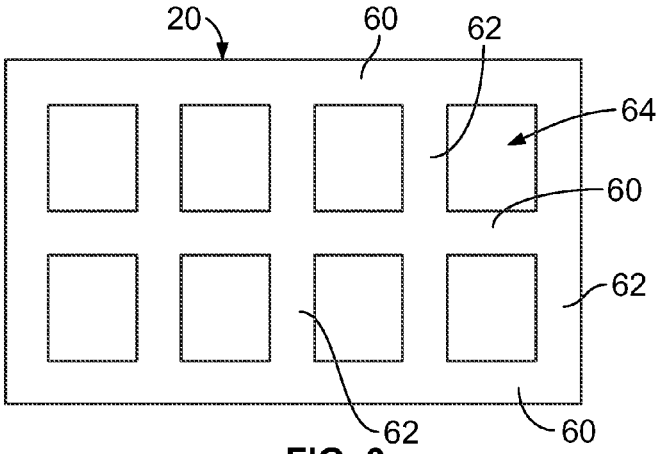
FIG. 3 illustrates an element frame of the patch antenna array formed in accordance with an exemplary embodiment.

FIG. 3 illustrates the element frame 20 formed in accordance with an exemplary embodiment. In an exemplary embodiment, the element frame 20 is a single piece structure used to hold down all of the patch antenna elements 18 (shown in FIG. 2). However in alternative embodiments, multiple elements frames may be used to hold down all of the patch antenna elements 18. The element frame 20 may be secured to a mounting surface of another structure using fasteners, clips, latches, adhesive, welding, solder, and the like.

In the illustrated embodiment, the element frame 20 includes segments in a lattice arrangement, thus defining a lattice frame. The element frame 20 includes longitudinal strips 60 and lateral strips 62 with windows 64 through the lattice frame. The windows 64 receive corresponding patch antenna elements 18. The longitudinal strips 60 and lateral strips 62 engage the corresponding patch antenna elements 18, such as the ledges 52 (shown in FIG. 2) to capture the patch antenna elements 18. The shapes of the windows 64 correspond to the shapes of the patch antenna elements 18. Optionally, the element frame 20 may include differently shaped windows 64 to accommodate differently shaped patch antenna elements 18.

Figure 4:
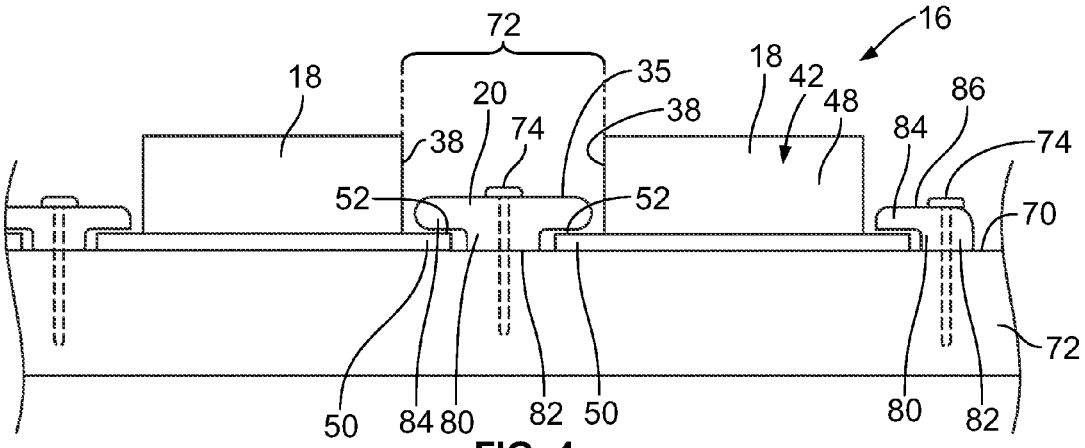
FIG. 4 is a partial sectional view of the patch antenna array showing the element frame mechanically securing the patch antenna elements.

FIG. 4 is a partial sectional view of the patch antenna array 16 showing the element frame 20 mechanically securing a plurality of the patch antenna elements 18 to a mounting surface 70 of a support substrate 72. The element frame 20 is illustrated secured to the support substrate 72 by fasteners 74.

The patch antenna elements 18 are held in position by the element frame 20. The patch antenna elements 18 are separated from each other such that a gap 76 is defined between the sides 38 of adjacent patch antenna elements 18. The bases 50 are aligned with each other across the gap 76 and are coplanar. Additionally, the ledges 52 are coplanar. The element frame 20 is positioned in the gap 76 and engages the patch antenna elements 18 on both sides of the gap 76. The element frame 20 is thus used to secure more than one patch antenna element 18. As noted above, the element frame 20 may be used to hold all of the patch antenna elements 18.

The element frame 20 includes a rail 80 at a bottom 82 of the element frame 20 and a cap 84 at a top 86 of the element frame 20. The cap 84 is wider than the rail 80 and is configured to extend over the ledges 52 of the adjacent patch antenna elements 18. The cap 84 is positioned in the gap 76 between the bodies 48 of the substrates 42 of the patch antenna elements 18. The rail 80 is positioned in the gap 76 between the bases 50. The element frame 20 may be fixed to the support substrate 72 by tightening the fastener 74 until the rail 80 bottoms out against the mounting surface 70 and/or until the cap 84 bottoms out against the ledges 52. The patch antenna elements 18 are mechanically secured to the support substrate 72 when captured by the element frame 20.

Figure 5:
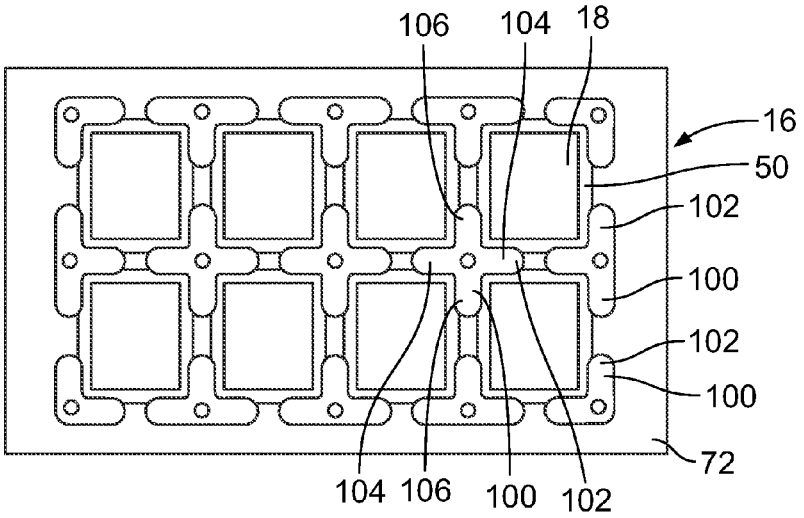
FIG. 5 is a top view of the patch antenna array in accordance with an exemplary embodiment.

FIG. 5 is a top view of the patch antenna array 16 using a plurality of element frames 100 to secure the array patch antenna elements 18. The element frames 100 are discrete pieces that are separately secured to the support substrate 72. The element frames 100 may have a cross-sectional shape similar to the element frame 20 (shown in FIG. 4). For example, the element frame 100 may include a rail (not shown) and a cap 102. The cap 102 engages and captures the bases 50 of the patch antenna elements 18.

The element frames 100 cooperate to secure each of the patch antenna elements 18. Each element frame 100 captures, positions and orients at least two patch antenna elements 18 relative to each other. As such, the total number of parts needed for assembly may be reduced. Optionally, each of the patch antenna elements 18 are held in place by more than one element frames 100.

In the illustrated embodiment, the element frames 100 are cross-shaped having both a longitudinal segment 104 and a lateral segment 106. The longitudinal and lateral segments 104, 106 may be equal in length or may have different lengths. The element frames 100 are positioned at the intersections between the patch antenna elements 18. In an exemplary embodiment, the element frames 100 capture the corners of the patch antenna elements 18. For example, each element frame 100 may be used to capture the corners of four patch antenna elements 18. Each corner of the patch antenna element 18 is captured by a different element frame. Optionally, the element frames 100 along the exterior of the patch antenna array 16 may be T-shaped, rather than being cross-shaped, to capture two patch antenna elements 18 rather than four patch antenna elements 18. The element frames 100 may be configured to position and orient the patch antenna elements in any desired pattern as required. Examples of array configurations include, but are not limited to, rectangular, hexagonal or circular lattices for regular or fragmented arrays.

The embodiments described and/or illustrated herein may provide a patch antenna array having multiple discrete patch antennas that are mechanically secured to a support substrate in a more reliable manner than at least some known patch antenna arrays. For example, the embodiments described and/or illustrated herein may provide an element frame that captures a ledge of one or more patch antenna elements to mechanically secure the patch antenna elements to the support substrate.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A patch antenna array comprising:

a plurality of discrete patch antenna elements spaced apart from each other and arranged as an array, each discrete patch antenna element having a substrate, a radiating patch associated with the substrate and a ground plane associated with the substrate, wherein the plurality of discrete patch antenna elements are discrete and separate from each other; and at least one element frame holding the discrete antenna elements in the array, each element frame capturing and positioning at least two patch antenna elements relative to each other, the at least one element frame comprising a lattice frame having longitudinal strips and lateral strips with windows through the lattice frame, the windows receiving corresponding discrete patch antenna elements, the longitudinal strips and lateral strips engaging the corresponding discrete patch antenna elements to capture, position and orient the discrete patch antenna elements.

2. The patch antenna array of claim 1, wherein the at least one element frame is positioned between corresponding patch antenna elements.

3. The patch antenna array of claim 1, wherein the substrates, the radiating patches, and the ground planes of the patch antenna elements are separated from one another with the corresponding at least one element frame positioned therebetween.

4. The patch antenna array of claim 1, wherein each patch antenna element has a top, a bottom and sides extending between the top and the bottom, the patch antenna elements being arranged in the array such that the sides of adjacent patch antenna elements face one another and are separated by gaps, the at least one element frame positioned in the corresponding gap and engaging the corresponding patch antenna elements to capture the patch antenna elements.

5. The patch antenna array of claim 4, wherein the at least one element frame engages at least two sides of corresponding patch antenna elements.

6. The patch antenna array of claim 1, wherein the at least one element frame comprises a plurality of discrete element frames, the element frames positioned between different patch antenna elements.

7. The patch antenna array of claim 6, wherein the element frames are positioned to capture corners of adjacent patch antenna elements.

8. The patch antenna array of claim 1, wherein the substrate has a thickness between a top and a bottom, the substrate having a non-constant cross-section along the thickness.

9. The patch antenna array of claim 1, wherein each patch antenna element has a top and a bottom, the patch antenna element having a ledge along the bottom, the at least one element frame engaging the ledge to capture the patch antenna element.

10. The patch antenna array of claim 9, wherein the at least one element frame includes a rail and a cap extending from the rail, the rail positioned between ledges of adjacent patch antenna elements, the cap extending over the ledges of the corresponding patch antenna elements to capture the patch antenna elements.

11. The patch antenna array of claim 1, wherein each patch antenna element has a top and a bottom, the patch antenna element having sides extending between a top and a bottom, the patch antenna element having at least one ledge extending from the corresponding side along a perimeter of the patch antenna element, the at least one element frame engaging the corresponding ledge to capture the patch antenna element.

12. A patch antenna array comprising:

a plurality of patch antenna elements spaced apart from each other and arranged as an array, each patch antenna element having a substrate, a radiating patch associated with the substrate and a ground plane associated with the substrate, the substrate having a base defining a ledge, wherein the plurality of patch antenna elements are discrete and separate from each other with the ledges generally coplanar and spaced apart from each other with gaps defined between adjacent ledges; and at least one element frame received in at least one of the gaps, the at least one element frame capturing the ledges of at least two patch antenna elements and holding the positions of the discrete antenna elements in the array relative to each other, the at least one element frame comprising a lattice frame having longitudinal strips and lateral strips with windows through the lattice frame, the windows receiving corresponding discrete patch antenna elements, the longitudinal strips and lateral strips engaging the corresponding discrete patch antenna elements to capture, position and orient the discrete patch antenna elements.

13. The patch antenna array of claim 12, wherein each patch antenna element has a top, a bottom and sides extending between the top and the bottom, the patch antenna elements being arranged in the array such that the sides of adjacent patch antenna elements face one another across the gaps, the at least one element frame positioned in the corresponding gap and engaging the corresponding patch antenna elements to capture the patch antenna elements.

14. The patch antenna array of claim 13, wherein the at least one element frame engages at least two sides of corresponding patch antenna elements.

15. The patch antenna array of claim 12, wherein the at least one element frame comprises a plurality of discrete element frames, the element frames positioned between different patch antenna elements.

16. The patch antenna array of claim 12, wherein the substrate has a thickness between a top and a bottom, the substrate having a non-constant cross-section along the thickness.

17. An antenna system comprising;

feed networks configured to be operatively connected to at least one of a receiver, a transmitter or a transceiver; and a patch antenna array mounted to a mounting surface of a support substrate, the patch antenna array comprising a plurality of patch antenna elements spaced apart from each other and arranged as an array, each patch antenna element having a substrate, a radiating patch associated with the substrate and a ground plane associated with the substrate, each radiating patch being operatively connected to a corresponding feed network for at least one of receiving radio frequency (RF) waves from the feed network or delivering RF waves to the feed network, wherein the plurality of patch antenna elements are discrete and separate from each other; and at least one element frame holding the discrete antenna elements in the array, each element frame capturing and positioning at least two patch antenna elements relative to each other, the at least one element frame comprising a lattice frame having longitudinal strips and lateral strips with windows through the lattice frame, the windows receiving corresponding discrete patch antenna elements, the longitudinal strips and lateral strips engaging the corresponding discrete patch antenna elements to capture, position and orient the discrete patch antenna elements.

* * * * *